US006357356B1

(12) United States Patent
Rim et al.

(10) Patent No.: US 6,357,356 B1
(45) Date of Patent: Mar. 19, 2002

(54) ELECTRIC BLASTING DEVICE USING ALUMINUM FOIL

(75) Inventors: Geun-Hie Rim, Seoul; Chu-Hyun Cho, Kyungsangnam-do, both of (KR)

(73) Assignee: Korea Electrotechnology Research Institute, Kyungsangnam-do (KR)

( * ) Notice: Subject to any disclaimer, the term of this patent is extended or adjusted under 35 U.S.C. 154(b) by 0 days.

(21) Appl. No.: 09/442,767

(22) Filed: Nov. 18, 1999

(51) Int. Cl.[7] ..... F42B 3/10
(52) U.S. Cl. ..... 102/202.7
(58) Field of Search ..... 102/202.7

(56) References Cited

U.S. PATENT DOCUMENTS 3,324,793 A * 6/1967 Thomas ..... 102/202.7
5,253,584 A * 10/1993 Allford ..... 102/202.7
5,431,104 A * 7/1995 Barker ..... 102/202.7 X
5,518,807 A * 5/1996 Chan et al. ..... 102/202.7 X
5,763,814 A * 6/1998 Avory et al. ..... 102/202.7 X
5,789,696 A * 8/1998 Lee et al. ..... 102/530 X
5,821,446 A * 10/1998 Chatley, Jr. ..... 102/202.7 X
5,939,660 A * 8/1999 Fogle, Jr. ..... 102/202.7 X
6,009,809 A * 1/2000 Whang ..... 102/202.7 X
6,119,599 A * 9/2000 Johnson et al. ..... 102/202 X

* cited by examiner

*Primary Examiner*—Peter A. Nelson
(74) *Attorney, Agent, or Firm*—Lowe Hauptman Gilman & Berner, LLP

(57) ABSTRACT

The present invention relates to an electric blasting device using aluminum foil, the objective of which lies in providing an economical and safe electric blasting device. In line with this objective; a portion of the outer conductor of the cable is removed, and the aluminum foil is inserted therein in order to electrically connect the inner and outer conductors. Between the aluminum foil and the inner conductor, water, an insulator, and a teflon tube are inserted. When pulse high-current is made to flow, the aluminum foil changes into the condition of plasma. The aluminum therefrom and water react to generate explosive power. The invention is economical in that it uses commercialized aluminum foil, in addition to having a short scattering distance of the fragments. It also allows a low-vibration blasting due to the short reaction time therein.

13 Claims, 2 Drawing Sheets

ELECTRIC BLASTING DEVICE USING ALUMINUM FOIL

TECHNICAL FIELD

The present invention relates to an electric blasting device, or more specifically to an electric blasting device using aluminum foil.

BACKGROUND ART

An electric blasting device has many advantages over the conventional blasting device, e.g., explosives or dynamites, in that it generates less vibration and noise with almost no spattering fragments. The conventional electric blasting devices of the past utilize customized aluminum wires or use a kneaded mixture of aluminum powder and water as explosives in order to cause chemical reactions therein. However, this sort of methods are problematic for the following reasons: (a) they must use customized aluminum wires or powder, which are difficult to find in the marketplace; (b) the reaction time is extended therein; and (c) the issue of safety arises due to the far-scattering fragments from blasting a bedrock.

SUMMARY OF THE INVENTION

In line with solving the aforementioned problems, the objective of the present invention lies in providing an economical and safe electric blasting device and an aluminum foil installation structure by means of using aluminum foil which is easily accessible in the marketplace, Instead of using hard-to-obtain aluminum powder or wires.

The present invention relates to an electric blasting device using aluminum foil, the objective of which lies in providing an economical and safe electric blasting device. In line with this objective, a portion of the outer conductor of the cable is removed, and the aluminum foil is inserted therein in order to electrically connect the inner and outer conductors. Between the aluminum foil and the inner conductor, water, an insulator, and a teflon tube are inserted. When pulse high-current is made to flow, the aluminum foil changes into the condition of plasmas and the aluminum therefrom and water react to generate explosive power.

DETAILED DESCRIPTION OF THE PREFERRED EMBODIMENTS

Figure 1:
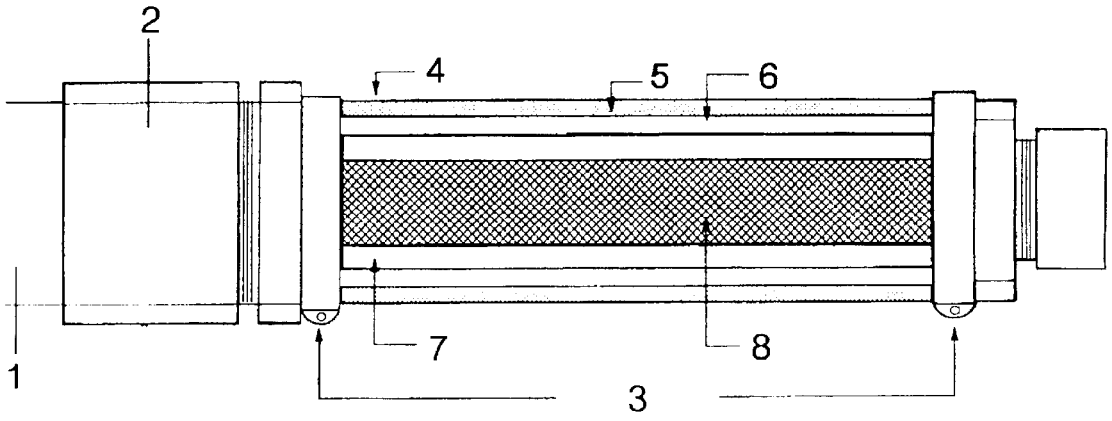
FIG. 1 is an outlined drawing of the electric blasting device using aluminum foil under the present invention.

The composition and the functions of the present invention, with references to attached drawings, are explained in detail as below. FIG. 1 is an outline drawing of the electric blasting device using aluminum foil under the present invention. As illustrated in FIG. 1, the electric blasting device of the present invention comprises a coaxial cable or the similar structure thereof (1), a cable terminal (2) for connecting said coaxial cable to the aluminum foil, a foil holder (3) for holding the aluminum foil (4) in a fixed position to said cable terminal (2), and aluminum foil (4) for generating explosive power by causing chemical reactions with water.

Figure 2:
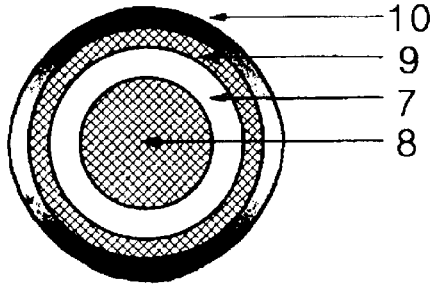
FIG. 2 is a cross-sectional drawing of the coaxial cable used in the electric blasting device using aluminum foil under the present invention.

As shown in FIG. 2, the coaxial cable or the similar structure thereof (1) comprises, from the center to the outside, an inner conductor (8), an insulator (7), an outer conductor (9), and an outer covering (10). The outer conductor (9) of the coaxial cable (1) is removed to the extent necessary, and a teflon tube (6) is inserted to prevent damage to the insulator (7). However, in some cases, a teflon tube (6) may not be necessary. The aluminum foil (4) which generates explosive power is made to cover the terminal (2) which is attached to the inner and outer conductors of the coaxial cable (1). With the attachment of the aluminum foil (4) to the cable terminal (2) in this manner, the outer conductor (9) of the coaxial cable (1) is electrically connected to the inner conductor (8) thereof. Between the teflon tube (6) and the aluminum foil (4), a small space is provided to be filled with water. Small holes are made in the aluminum foil for filling the interior with water.

Having such structure as above, the electric blasting device of the present invention is made to operate with the following principles: When a high-current pulse flows through the aluminum foil (4), heat is generated by resistance of the aluminum foil (4), causing a further increase in resistance of the aluminum foil (4). Consequently, more heat is generated, increasing in a non-linear manner, and most of the energy stored in the capacitor is consumed by the aluminum foil (4). Since most of the energy is consumed in such an intensified manner, the aluminum foil becomes evaporated, in effect, turning into plasma. Expansion force is primarily generated by volume expansion of the aluminum, and the secondary chemical energy is emitted by reaction of aluminum plasma with oxygen in water. Consequently, the pressure is further increased, and the explosive power is so generated.

Here, the optimal cross-sectional area and the length of the aluminum foil can be calculated from the following Mathematical Formulas 1 and 2. If the formulas are satisfied, the point of energy consumption by aluminum foil (4) is at the current. All of the energy consumed is minimized, thereby generating more power.

Mathematical Formula 1

$$A^2 = \frac{E^{3/2}}{VL_S^{1/2}K_v} \qquad \text{Mathematical Formula 1}$$

Mathematical Formula 2

$$l = \frac{EL_L}{\rho_m A\zeta(L_S + L_l)} \qquad \text{Mathematical Formula 2}$$

Here, A is the cross-sectional area. l is length. E is the energy stored by a capacitor at voltage V. $L_s$ is a circuit inductance. $L_L$ is a load inductance. $P_m$ is density. $\zeta$ is evaporation energy. $K_v$ is a constant. For the material constants with respect to aluminum, $P_m$ is $10.5\times10^3$ kg/m$^3$, $K_v$ is $2.2\times10^{16}$ [MKS], and $\zeta$ is $10.8\times10^6$J/kg.

FIG. 2 is a cross-sectional drawing of the coaxial cable (1) used in the electric blasting device utilizing aluminum foil of the present invention. There, the coaxial cable (1) comprises an inner conductor (8), an outer conductor (9), an insulator (7) inserted between the two conductors, and a protective outer covering or stainless steel pipe protective structure (10).

Figure 3:
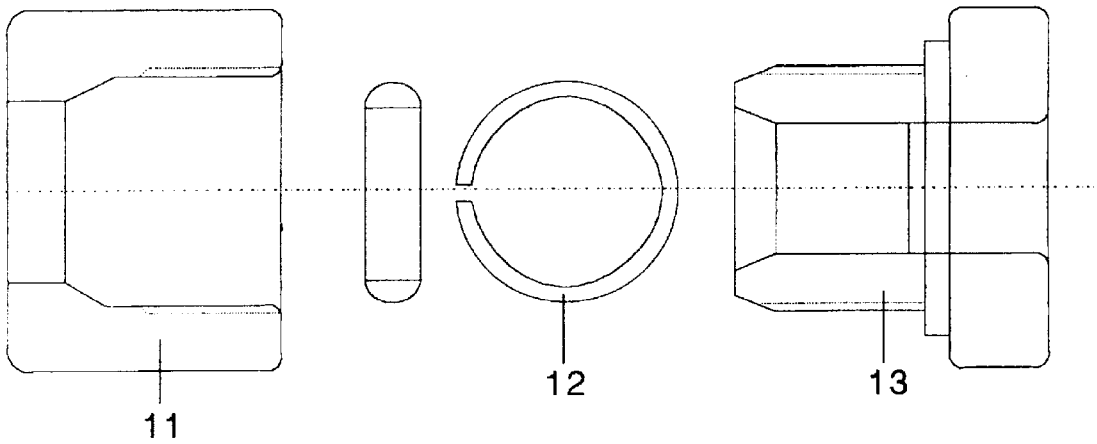
FIG. 3 is an outlined drawing of the cable terminal under the present invention.

FIG. 3 is an outline drawing of the cable terminal (2) used in the present invention. The cable terminal (2) comprises a female screw (11), a contact ring (12), and a male screw (13). When screws (11) and (13) are screwed into place, the contact ring (12) is compressed and tightened firmly against the cable (1). As such, an electric contact is made while enabling terminal (2) to withstand the mechanical force therein. The advantages of the present structure lie in achieving coaxiality which reduces unnecessary inductance and in effectively withstanding the magnetic force generated by pulse high-current.

As compared to the conventional explosives and dynamites used in the construction sites, i.e., for blasting bedrock and buildings, and dismantling concrete structures, a blasting device utilizing a very economical and safe aluminum foil by means of the present invention can be used as a replacement therein.

Further, as compared to the conventional electric blasting devices utilizing aluminum wires or powder, the present invention is highly economical in that it uses an ordinary commercialized aluminum foil, allows low-vibration blasting due to the short reaction time, and enhances safety due to the short scattering distance at the time of blasting.

Further, with easy installation, the present invention by using a coaxial cable structure can minimize the inductance of the transmission line, and is highly effective due to its symmetrical structure.

What is claimed is:

1. An electric blasting device, which comprises:

(a) a coaxial cable comprising a coaxial inner conductor at the center, an outer conductor, and an insulator for insulating said outer and inner conductors;

(b) aluminum foil;

(c) a cable terminal which connects said coaxial cable and said aluminum foil:

(d) a teflon tube which is inserted onto said inner conductor for preventing damage thereto;

(e) an insulator for insulating said inner and outer conductors;

(f) water, inserted between said aluminum foil and the teflon tube, at a location for enabling the water to react with the aluminum foil; and (g) said aluminum foil, after removing a certain portion of the outer conductor of said coaxial cable, to the extent necessary for blasting, which is inserted therein to electrically connect the outer conductor of said coaxial cable to the inner conductor, thereby attaching onto the cable terminal through a foil holder, said aluminum foil and the water being arranged to provide a reaction for generating explosive power.

2. An electric blasting device according to claim 1, wherein said cable terminal comprises a female screw, a male screw, and a contact ring, and said male screw is connected to the female screw through said contact ring.

3. An electric blasting device for connection to a coaxial cable and for activation to provide explosive power in response to a high-voltage pulse being applied between inner and outer conductors of the coaxial cable, the blasting device comprising a coaxial connector for connecting the inner and outer conductors of the cable to first and second coaxial conductors of the blasting device, the first and second coaxial conductors of the blasting device being respectively inner and outer conductors of the blasting device, the second conductor including a metal that vaporizes and forms a plasma in response to the high-voltage pulse being applied by the coaxial connector to the first and second coaxial conductors, a solid insulator between the first and second conductors, a volume for receiving a liquid between an exterior surface of the solid insulator and an interior surface of the metal; the connector, the first and second conductors, the insulator and the volume being such that in response to the pulse being applied to the connector by the conductors of the cable a discharge current for causing the explosive power flows between the first and second conductors, through the insulator and the liquid when the liquid is in the volume.

4. The device of claim 3 wherein the metal is a tube shaped foil.

5. The device of claim 4 wherein the foil includes openings for enabling the liquid to be poured into the volume.

6. The device of claim 5 further including the liquid in the volume.

7. The device of claim 6 wherein the foil and the liquid are respectively aluminum and water.

8. The device of claim 3 wherein a solid structure in the device includes openings for enabling the liquid to be poured into the volume.

9. The device of claim 3 further including the liquid in the volume.

10. The device of claim 9 wherein the foil and the liquid respectively include aluminum and water.

11. The device of claim 10 wherein the metal is aluminum foil.

12. The device of claim 11 wherein the aluminum foil is shaped as a tube.

13. The device of claim 12 further including a metal protective structure coaxial with the first and second conductors and surrounding the second conductor.

* * * * *